US012491601B2

(12) United States Patent
Gopinath et al.

(10) Patent No.: US 12,491,601 B2
(45) Date of Patent: Dec. 9, 2025

(54) COMPONENT TREATMENT METHOD AND APPARATUS

(71) Applicants: ROLLS-ROYCE plc, London (GB); ROLLS-ROYCE DEUTSCHLAND LTD & CO KG, Dahlewitz (DE)

(72) Inventors: Abhay Gopinath, Singapore (SG); Arun Prasanth Nagalingam, Singapore (SG); Goetz G Feldmann, Oberursel (DE); Thomas Haubold, Wehrheim (DE); Senthil Kumar Anantharajan, Singapore (SG)

(73) Assignees: ROLLS-ROYCE plc, London (GB); ROLLS-ROYCE DEUTSCHLAND LTD & CO KG, Dahlewitz (DE)

( * ) Notice: Subject to any disclaimer, the term of this patent is extended or adjusted under 35 U.S.C. 154(b) by 436 days.

(21) Appl. No.: 18/172,121

(22) Filed: Feb. 21, 2023

(65) Prior Publication Data

US 2023/0294236 A1 Sep. 21, 2023

(30) Foreign Application Priority Data

Mar. 15, 2022 (GB) ..... 2203546

(51) Int. Cl.
*B24B 31/06* (2006.01)
*B24B 19/14* (2006.01)

(52) U.S. Cl.
CPC ..... *B24B 31/064* (2013.01); *B24B 19/14* (2013.01)

(58) Field of Classification Search
CPC ..... B24B 31/06; B24B 31/064; B24B 31/003; B24B 31/02; B24B 31/0224; B24B 31/023
See application file for complete search history.

(56) References Cited

U.S. PATENT DOCUMENTS 10,369,674 B2 8/2019 Cezario et al.
10,406,651 B2 9/2019 Tan et al.
(Continued)

FOREIGN PATENT DOCUMENTS

DE 69110203 T2 10/1995
DE 10 200 502 4733 A1 12/2006
(Continued)

OTHER PUBLICATIONS

Goetz Feldmann et al., "2nd CIRP 2nd CIRP Conference on Surface Integrity (CSI) Application of Vibropeening on Aero-Engine Component", ScienceDirect Procedia CIRP 13, (2014), pp. 423-428.
(Continued)

*Primary Examiner* — Joel D Crandall
(74) *Attorney, Agent, or Firm* — Oliff PLC

(57) ABSTRACT

A method for modifying the mechanical and surface properties of a component. The method involves: removably attaching a component to at least one component support that is located within a vibratory trough of a component treatment apparatus, the at least one component support being a support shaft upon which the component is removably mountable within the vibratory trough; supplying the vibratory trough with treatment media; moving the component support or the vibratory trough so that the component is immersed into the treatment media; vibrating the vibratory trough to provide a substantially uniform surface treatment of the component, the vibratory trough being movable by at least one trough vibrating mechanism whose actuation is controlled by a controller in response to signals received from at least one sensor located on or within the vibratory trough; removing the component from the treatment media; and detaching the component from the component support.

17 Claims, 5 Drawing Sheets

(56) References Cited

U.S. PATENT DOCUMENTS

| | | | | |
|---|---|---|---|---|
| 2004/0242134 | A1 | 12/2004 | Lee | |
| 2007/0107217 | A1* | 5/2007 | Baus | B24B 31/073 29/889.1 |
| 2010/0287772 | A1 | 11/2010 | Hennig et al. | |
| 2011/0017006 | A1* | 1/2011 | Wern | B24C 1/10 451/36 |
| 2011/0256809 | A1 | 10/2011 | Baudimont et al. | |
| 2012/0266426 | A1 | 10/2012 | Feldmann et al. | |
| 2013/0216391 | A1 | 8/2013 | Feldmann | |
| 2013/0307088 | A1 | 11/2013 | Yang et al. | |
| 2016/0346896 | A1* | 12/2016 | Tian | B24B 31/003 |
| 2022/0226964 | A1* | 7/2022 | Liske | B24B 49/02 |

FOREIGN PATENT DOCUMENTS

| | | | | |
|---|---|---|---|---|
| DE | 10 200 902 1582 | A1 | 12/2010 | |
| DE | 10 2011 007 705 | A1 | 11/2012 | |
| DE | 10 2013 107 493 | A1 | 1/2015 | |
| DE | 10 2013 107 494 | A1 | 1/2015 | |
| DE | 102013107497 | A1 * | 1/2015 | B23P 9/00 |
| DE | 10 2021 101 245 | A1 | 7/2022 | |
| EP | 0 463 846 | A2 | 1/1992 | |
| EP | 3 225 356 | A1 | 10/2017 | |
| EP | 4 033 320 | A1 | 7/2022 | |
| EP | 4371704 | A1 * | 5/2024 | B24B 31/064 |
| SU | 984832 | A1 | 12/1982 | |
| WO | WO-0029171 | A1 * | 5/2005 | F04D 29/321 |
| WO | 2012/052873 | A2 | 4/2012 | |
| WO | 2013/113302 | A1 | 8/2013 | |

OTHER PUBLICATIONS

Goetz G. Feldmann et al., "Application of Vibropeening on Aero-Engine Components", ICSP 12 International Conference on Shot Peening Goslar (2014), pp. 1-8.

Aug. 17, 2022 Search Report and Office Action issued in British Patent Application No. 2203546.3.

Aug. 9, 2023 extended Search Report issued in European Patent Application No. 23156753.8.

* cited by examiner

COMPONENT TREATMENT METHOD AND APPARATUS

CROSS-REFERENCE TO RELATED APPLICATIONS

This specification is based upon and claims the benefit of priority from United Kingdom patent application number GB 2203546.3 filed on Mar. 15, 2022, the entire contents of which is incorporated herein by reference.

BACKGROUND

1. Technical Field

The present disclosure relates to a method and an apparatus for modifying the mechanical and surface properties of components. More particularly, the present disclosure provides a method and an apparatus for modifying the mechanical and surface properties of gas turbine engine components, e.g. aerofoils, in order to prolong their useful life and/or performance.

2. Description of the Related Art

Mechanical articles typically degrade in various ways over time especially when operated for long durations of time in extremes of temperature. The degradation often primarily or at least initially tends to occur at one or more surfaces of the articles concerned.

It is known in the aerospace industry to treat the surface of components, especially gas turbine components such as compressor blades, turbine blades and bladed integrated disks in order to modify the performance and/or appearance of those components.

It is well known that polishing a metal surface can improve its appearance. It involves rubbing the surface and/or applying a chemical substance to it to make the surface smooth and shiny.

Vibropolishing, aka ball pressure polishing, is a polishing method that involves placing an article in a container of specially shaped pellets and vibrating the container so that the pellets rub against the article to deburr, radius, descale, burnish, clean and/or brighten its surface. While vibropolishing is useful for improving the surface roughness of aerospace components it can undesirably remove material and detrimentally affect aerofoil geometries.

The process of working on a metal surface to improve its material properties is known as peening. Certain types of peening reflect the manner in which the metal surface is worked upon. Peening is not restricted to metal surfaces. It is for example possible to peen composite materials.

Shot peening is a cold working process that involves striking the surface of metal or composite with shot with sufficient force to produce a compressive residual stress layer by plastic deformation. The shot can for example be in the form of round metallic, glass, or ceramic particles. The process is intended to modify the mechanical properties of the metal or composite without removing any appreciable material. It is known to use shot peening to strengthen car crankshafts and connecting rods. While shot peening is useful for providing desired compressive residual stresses in aerospace components it typically undesirably increases surface roughness.

Vibropenning is a process that combines vibratory polishing and shot peening from a single polishing process in a vibratory bowl. Also known as ball polishing, it is known to be useful for improving the appearance of car wheels, various types of furniture, and cutlery. Feldman et al, "Application of vibropeening on aero-engine component", *Procedia CIRP* 13, (2014), pages 423 to 428, discusses the use of vibropeening as an alternative to the shot peening and vibropolishing of blisk assembly aerofoils.

U.S. Pat. No. 10,406,651 discloses a method and apparatus for vibro-treating an object, e.g. a gas turbine engine aerofoil or bladed disk. The method includes the steps of controlling a relative displacement between a vibro-treating media and a surface area of the object to provide a vibro-treating effect; and, controlling movement of the object relative to a surface of the vibro-treating media whilst controlling relative displacement between the vibro-treating media and the surface area of the object to provide a substantially even vibro-treating condition over the surface area of the object. Such a method however is not suitable for vibro-treating larger gas turbine engine components such as bladed disk drums or for focusing vibro-treatment on specific parts of gas turbine engine components.

Tests have shown that vibro-treating, i.e. vibropeening or vibropolishing, bladed disk drums and fan blades of a gas turbine engine results in a non-uniform residual stress distribution and material properties across its length due to asymmetry of the component along its length. This undesirably increases treatment time and process cost.

The present disclosure provides a method and a component treatment apparatus for modifying the mechanical and surface properties of components that addresses the shortcomings of conventional polishing and peening methods, or at least provides a useful alternative to same.

SUMMARY OF THE DISCLOSURE

In a first aspect there is provided a method for modifying the mechanical and surface properties of a component, the method comprising the steps of: (a) removably attaching a component to at least one component support that is located within a vibratory trough of a component treatment apparatus, the at least one component support being a support shaft upon which the component is removably mountable within the vibratory trough; (b) supplying the vibratory trough with treatment media; (c) moving the component support or the vibratory trough so that the component is immersed into the treatment media; (d) vibrating the vibratory trough to provide a substantially uniform surface treatment of the component, the vibratory trough being movable by at least one trough vibrating mechanism whose actuation is controlled by a controller in response to signals received from at least one sensor located on or within the vibratory trough; (e) removing the component from the treatment media; and (f) detaching the component from the component support.

With this method uniform residual stress and other material properties are achieved throughout the component. This can improve fatigue life and/or performance of the component. This is particularly important when the component is large in size.

In some embodiments the treatment media supplied to the vibratory trough is selected from a metal, a composite material and a plastic material.

In some embodiments the treatment media is a metal selected from stainless steel, carbon steel and copper.

In some embodiments the treatment media is formed as cones, ball cones, spheres, pyramids or angle cut cylinders.

In some embodiments the inclination of the component support is adjustable within the vibratory trough to enable selected portions of the component to be uniformly treated within the vibratory trough.

In some embodiments the component is a gas turbine engine component.

In some embodiments the gas turbine engine component is a bladed disk drum or a fan blade.

In a second aspect there is provided a component treatment apparatus for modifying the mechanical and surface properties of a component, the component treatment apparatus comprises: a vibratory trough for receiving and retaining treatment media; a component support that supports the component within the vibratory trough, the component support being a support shaft upon which the component is removably mountable within the vibratory trough; at least one sensor that is mounted on the vibratory trough; at least one trough vibrating mechanism that causes the vibratory trough to vibrate; and a controller that controls the at least one trough vibrating mechanism in response to signals received by the at least one sensor thereby controlling the vibratory motion of the vibratory trough In some embodiments the vibratory trough has a substantially u-shaped cross-section or has a shape that corresponds at least in part to the shape of the component.

In some embodiments the at least one trough wall is provided in the vibratory trough that controls the energy of peening by adjusting height, volume and mass of the treatment media.

In some embodiments the vibratory trough has at least one guide vanes that directs a flow of treatment media over the component to optimise local energy flow on the component.

In some embodiments the support shaft that passes through the component to support the component within the vibratory trough.

In some embodiments the at least one trough vibrating mechanism comprises an actuator and an actuator extension rod or a shape memory alloy spring.

In some embodiments the at least one sensor is a plurality of sensors located on and around the vibratory trough and/or one sensor is located adjacent the component within the vibratory trough.

In some embodiments the vibratory trough has a treatment media inlet for controllably supplying the treatment media into the vibratory trough and a treatment media outlet for controllably emptying the treatment media from the vibratory trough, control of the treatment media inlet and the treatment media outlet being provided by the controller or an additional controller.

In some embodiments the component is a gas turbine engine component.

In some embodiments the gas turbine engine component is a bladed disk drum or a fan blade.

The term "shot peening" as used herein is a method of modifying the mechanical properties of an article that involves striking the surface of the article, typically made of metal or composite, with shot with sufficient force to produce a compressive residual stress layer in the article by plastic deformation. The method tends to result in the article having a rough surface.

The term "vibrofinishing" (aka vibratory finishing) as used herein is a method for polishing the surface of an article, typically made of metal or composite, which involves vibrating the article amongst certain specially shaped pellets to decrease the surface roughness of the article. Shot peened articles are often vibrofinished to reduce their surface roughness, with the vibrofinishing typically removing some material from the article but typically not affecting the residual stress created during the shot peening process. It is typically advisable to minimise any vibropolishing in order to minimise the removal of material. Indeed excessive vibropolishing shot peened articles can remove the compressive residual stress layer formed by the shot peening.

The term "vibropeening" (aka vibratory peening) as used herein is a method of modifying the mechanical and surface properties of an article, typically made of metal of composite, that involves vibrating the article within a treatment media to polish the article, reduce its surface roughness, and to induce compressive residual stress on the article. Vibropeening tends to provide a superior surface finish to shot peening. It also tends to provide a deeper layer of compression than shot peening albeit typically providing somewhat less residual stress than shot peening.

The term "fatigue life" as used herein means the time by which a component or material will last before completely failing because of concentrated stresses.

Throughout this specification and in the claims that follow, unless the context requires otherwise, the word "comprise" or variations such as "comprises" and "comprising", will be understood to imply the inclusion of a stated integer or group of integers but not the exclusion of any other stated integer or group of integers.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

Figure 1:
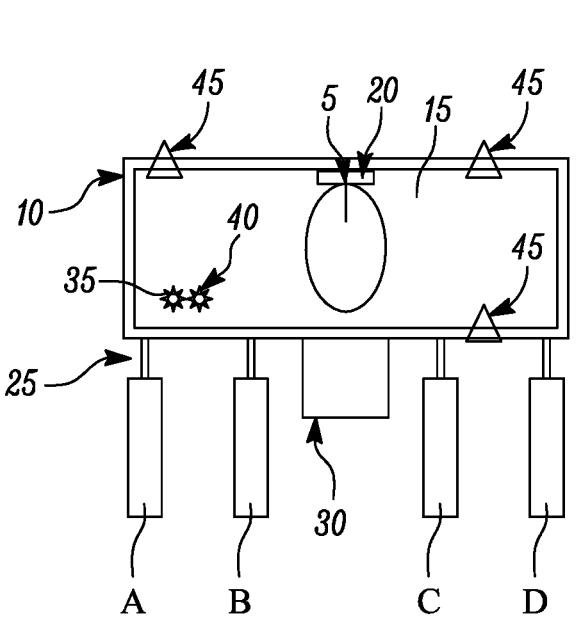
FIG. 1 is a schematic front view of a component treatment apparatus.

The following table lists the reference numerals used in the drawings with the features to which they refer:

| Ref no. | Feature | FIGURE |
|---|---|---|
| 1 | Component treatment apparatus | 1 2 3 4 5 6 7 8 |
| 5 | Component e.g. bladed disk drum | 1 3 5 6 7 9 |
| 10 | Vibratory trough | 1 2 3 4 5 6 7 8 |
| 15 | Treatment media | 1 3 5 7 |
| 20 | Component support e.g. hollow support shaft | 7 10 11 12 13 |
| 25 | Actuator extension rod | 1 2 5 6 |
| 30 | Controller | 1 2 3 4 5 6 7 8 |
| 35 | Treatment media inlet | 1 3 5 7 |
| 40 | Treatment media outlet | 1 3 5 7 |
| 45 | Sensor | 1 3 5 7 |
| 50 | Shape memory alloy spring | 3 4 7 8 |
| 55 | First trough wall | 7 |
| 60 | Second trough wall | 7 (10) |
| 65 | Rotational axis of the component support | 10 |
| 70 | Bottom of the vibratory trough | 10 |
| 75 | Trough wall motor | 11 12 13 |
| 80 | Component support motor | 11 12 13 |
| A | Actuator | 1 2 3 4 5 6 7 8 |
| B | Actuator | 1 2 3 4 5 6 7 8 |
| C | Actuator | 1 3 5 7 |
| D | Actuator | 1 3 5 7 |
| E | Actuator | 5 |
| F | Actuator | 5 |
| H | Horizonal distance between the bladed disk drum and the second trough wall | 10 |
| V | Vertical distance between the bladed disk drum and the bottom of the vibratory trough | 11 |

DETAILED DESCRIPTION OF THE DISCLOSURE

Aspects and embodiments of the present disclosure will now be discussed with reference to the accompanying figures. Further aspects and embodiments will be apparent to those skilled in the art.

The present disclosure relates to a method and an apparatus for modifying the mechanical and surface properties of components, more particularly a method and an apparatus for modifying the mechanical and surface properties of gas turbine engine components, e.g. aerofoils, in order to prolong their useful life and/or performance.

In broad terms, the method for modifying the mechanical and surface properties of components comprises the steps of:

(a) removably attaching a component to a component support that is located within a vibratory trough of a component treatment apparatus, the at least one component support being a support shaft upon which the component is removably mountable within the vibratory trough;

(b) supplying the vibratory trough with treatment media;

(c) moving the component support or the vibratory trough so that the component is immersed into the treatment media;

(d) vibrating the vibratory trough to provide a substantially uniform surface treatment of the component, the vibratory trough being movable by at least one trough vibrating mechanism whose actuation is controlled by a controller in response to signals received from at least one sensor located on or within the vibratory trough;

(e) removing the component from the treatment media; and (f) detaching the component from the component support.

Step (a) of the method of the present disclosure involves removably attaching a component to a component support that is located within a vibratory trough of a component treatment apparatus. The component support is a support shaft upon which the component is removably mountable within the vibratory trough The component treatment apparatus, which can take various forms, is described in more detail below. Certain embodiments of the component treatment apparatus are depicted in the accompanying drawings and described below. The component treatment apparatus includes a vibratory trough i.e. a trough for containing treatment media, typically solid treatment media albeit typically suspended in a liquid or semi solid paste. The vibratory trough can take a variety of forms with respect to construction, shape and materials. In some embodiments the vibratory trough has a substantially u-shaped cross-section. In other embodiments the vibratory trough has a shape that corresponds at least in part to the shape of a particular component for which the vibratory trough is dedicated. The component support can take a variety of forms, the chosen form being suitable to support the component or components that are typically selected to be treated in the component treatment apparatus. The component support is a support shaft. In some embodiments the support shaft is a hollow shaft. In some embodiments the component support can be oriented to optimise the uniformity of treatment of certain parts of the component in the vibratory trough. The component can be removably attached to the component support in a variety of ways, typically reflecting the size, shape and weight of the component concerning. In some embodiments the component treatment apparatus has an arrangement that is suitable for removably attaching various components to the component support. In some embodiments the component treatment apparatus has an arrangement that is bespoke for removably attaching a particular component or type of component to the component support.

Step (b) of the method of the present disclosure involves supplying the vibratory trough with treatment media. The treatment media can take various forms but it is typically a solid treatment media, albeit typically suspended in a liquid or semi solid paste, the liquid or paste typically enabling more efficient polishing peening process. The choice of treatment media depends on the components to be treated and the desired mechanical and surface properties of the component that is to be treated. In some embodiments the treatment media is a metal such as stainless steel, carbon steel or copper, or it is a ceramic material or it is a plastic material. The treatment media can be provided in a variety of shapes such as cones, ball cones, spheres, pyramids and/or angle cut cylinders. In some embodiments the vibratory trough of the component treatment apparatus has a treatment media inlet for controllably supplying treatment media into the vibratory trough and/or a treatment media outlet for controllably emptying treatment media from the vibratory trough.

In some embodiments a compound is added to the treatment media to achieve a shiny surface finish along the length of the component, to achieve a uniform surface finish first through abrasive mechanism, and then achieve fatigue improvement through the peening mechanism. The compound may be any substance that is suitable for this purpose. It can for example by a chemical substance, a soap solution, or an abrasive substance, such as a fine micro abrasive substance. The compound may be added in solution form, suitably diluted as desired.

In some embodiments the compound is directed through a hoe system that has a digital capability to control flow. For example, a flow meter is turned to "5 minutes" and then the compound is poured into the vibratory trough over a period of 5 minutes.

Step (c) of the method of the present disclosure involves moving the component support or the vibratory trough so that the component is immersed into the treatment media: The manner in which the component support or the vibratory trough moves to achieve this depends on the equipment used for this purpose. In some embodiments the component support is adapted to simply lower the component in the interior of the vibratory trough sufficiently for the component to be partially or substantially immersed in the treatment media.

Step (d) of the method of the present disclosure involves vibrating the vibratory trough to provide a substantially uniform surface treatment of the component. The vibratory trough is movable by at least one trough vibrating mechanism whose actuation is controlled by a controller in response to signals received from at least one sensor located on or within the vibratory trough. The sensor(s) measure either the acceleration of the component due to vibration or the impact force exerted by the media on the component. The treatment media is relatively impacting the component at user-defined energy (intensity) locally to the component, thereby imparting improved fatigue behaviour and mechanism through a plastic deformation-based surface improvement like micro hammering instead of erosion. In other words, the treatment media simultaneously peens and polishes the component within the vibratory trough. For the vibropeening, the media impacts and induces a local stress on the surface and just below the surface of the component through plastic deformation which results in smoother surface and compressive residual stress. The sensor data can be adjusted to obtain desired residual stress at different areas so that the residual stress is substantially uniform. Otherwise different sections may have different plastic deformations and therefore no uniformity.

Step (e) of the method of the present disclosure involves removing the component from the treatment media. In manner in which this is achieved will typically depend on the manner in which the component was immersed into the treatment media. In some embodiments the component support is operated to lift the component out of the treatment media. In some embodiments a sufficient volume of the treatment media is evacuated or otherwise removed from the vibratory trough so that the component is no longer immersed in the treatment media, for example by drawing treatment media from the vibratory trough through the treatment media outlet provided.

Step (f) of the method of the present disclosure involves detaching the component from the component support. The manner in which the component is detached from the component support depends on how the component was removably attached to the component support in step (a) of the method.

In broad terms the component treatment apparatus of the present disclosure comprises: a vibratory trough for receiving and retaining treatment media; a component support that supports the component within the vibratory trough, the component support being a support shaft upon which the component is removably mountable within the vibratory trough; at least one sensor that is mounted on the vibratory trough; at least one trough vibrating mechanism that causes the vibratory trough to vibrate; and a controller that controls the at least one trough vibrating mechanism thereby controlling the vibratory motion of the vibratory trough.

The component treatment apparatus of the present disclosure can take various forms. Four embodiments of the component treatment apparatus are depicted in the drawings and will now be described in turn.

Figure 2:
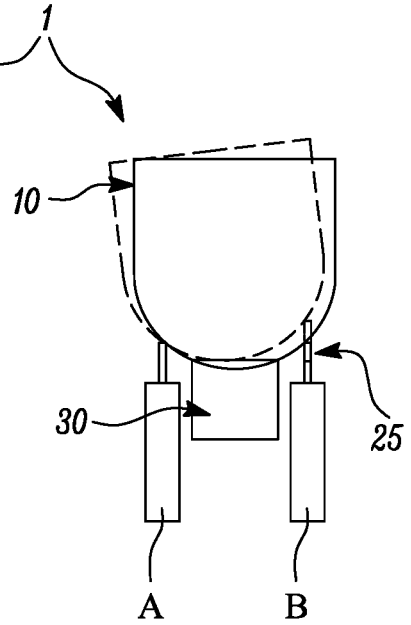
FIG. 2 is a schematic side view of the component treatment apparatus that is shown in FIG. 1.

FIGS. 1 and 2 depict a first embodiment of the component treatment apparatus of the present disclosure. They provide a schematic front view and a schematic side view of the embodiment respectively. FIG. 1 shows a component treatment apparatus 1 for modifying the mechanical and surface properties of a component 5. The component for example is a gas turbine engine component and the component treatment apparatus is used to modify the mechanical and surface properties of the gas turbine engine component in order to prolong its useful life and/or performance. The component treatment apparatus has a vibratory trough 10 for containing treatment media 15 and at least one component support 20 that is located within the vibratory trough, the component support is a support shaft upon which the component is removably mountable within the vibratory trough. The vibratory trough can take a variety of forms with respect to inter alia construction, shape and materials. In the embodiment shown, the vibratory trough has a substantially u-shaped cross-section as this facilities a substantially uniform media flow in a desired direction when the vibratory trough is in operation. For example, this is useful when treating the pressure and suction sides of aerofoils respectively.

In the embodiment shown, the vibratory trough is composed of a metal, e.g. aluminium or steel, and it is lined with a layer of polyurethane to protect the vibratory trough and avoid any chemical reaction with the construction material of the vibratory trough. The polyurethane layer also serves to ensure the treatment media flows smoothly within the trough. It can also be useful to apply a layer of polyurethane to metal parts of the component treatment apparatus for which any polishing is not required or is undesirable. While in the embodiment shown the vibratory trough is lined with a layer of polyurethane, other materials may be used instead to fulfil the same or similar purpose, e.g. the vibratory trough may be lined with another polymeric material.

The component support can take a variety of forms, the chosen form being suitable to support the component that is selected to be treated in the component treatment apparatus.

The component treatment apparatus includes suitable equipment for the vibratory trough to be rocked or otherwise oscillated as desired. In the embodiment shown the component treatment apparatus has a system of actuators A-D and actuator extension rods 25. One end of each actuator extension rod is adapted to be securable with the vibratory trough so that any movement of the actuator extension rod within its actuator causes the vibratory trough to move. The actuator extension rods are individually extendable as necessary. The actuators of the embodiment shown are hydraulic but can be pneumatic or otherwise to be suitable for their purpose. The actuators are controlled by a controller 30 and the controlled actuation of the actuators causes the vibratory trough to move as desired, e.g. rocking the vibratory trough from side to side, from end to end, or from one corner to another corner, and according to a desired frequency, pattern and duration.

The controller 30 may take any form suitable for its purpose. For example, controller may include a processor (not shown) and a memory (not shown). The memory may include computer executable instructions that are executable by the processor to perform the logic of the computer-controllable unit or portions thereof that are described above. One or more analogue to digital converters may be used to process signals from various sensors.

In the embodiment shown the vibratory trough 10 has a treatment media inlet 35 and a treatment media outlet 40. These can take any suitable form for their respective purposes, the treatment media inlet 35 for controllably supplying treatment media into the vibratory trough and the treatment media outlet 40 for controllably emptying treatment media from the vibratory trough. Control of the treatment media inlet and the treatment media outlet may be manual or provided by the controller 30 or an additional controller.

In the embodiment shown the component treatment apparatus 1 has a plurality of sensors 45 that are located on and around the vibratory trough 10 and/or one sensor is located adjacent the component that is selected to be treated in the component treatment apparatus. The controller 30 may controls the actuations of the each of the actuators A to D based on the signals received from one or more of the plurality of sensors 45.

FIG. 2 shows the vibratory trough 10 has a substantially u-shaped cross-section and the actuation of actuator B, for example in concert with the actuation of actuator D (not shown), causes the vibratory trough to rock towards the actuators A and C. The actuation of actuators B and D is controlled by the controller 30.

Figure 3:
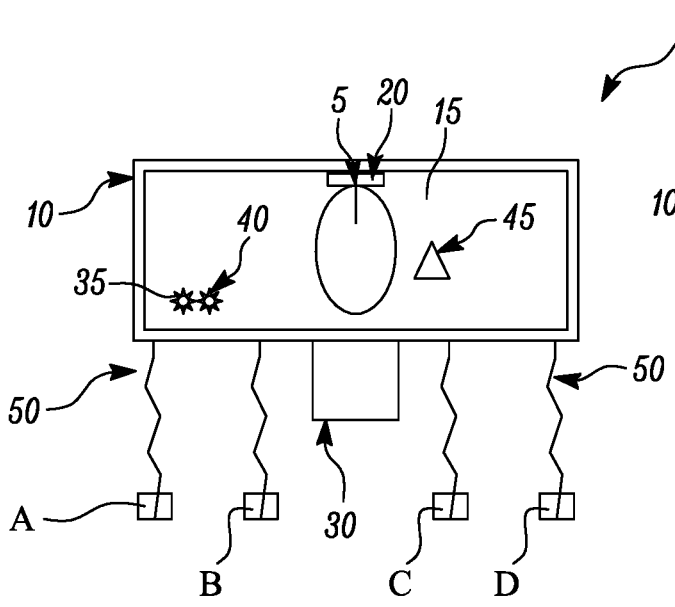
FIG. 3 is a schematic front view of a component treatment apparatus.
Figure 4:
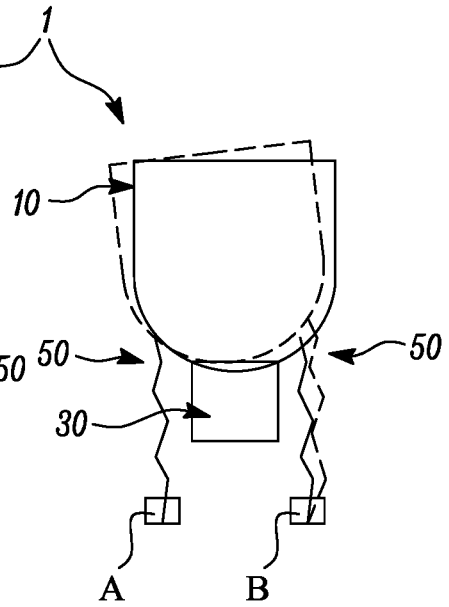
FIG. 4 is a schematic side view of the component treatment apparatus that is shown in FIG. 3.

FIGS. 3 and 4 depict a second embodiment of the component treatment apparatus of the present disclosure. They provide a schematic front view and a schematic side view of the embodiment respectively. The second embodiment shares most of the features of the first embodiment and the reference numerals in FIGS. 3 and 4 that also appear in FIG. 1 or 2 refer to corresponding the features. In the second embodiment each actuator A to D is in the form of a shape memory alloy excitation unit and each shape memory alloy excitation is provided with a shape memory alloy spring 50. The controller 30 receives signals from a sensor 45 that is located on the inner side of the vibratory trough in close proximity to the component to be treated and the controller controls the excitation unit to vary the spring extension and thereby move the vibratory trough as required. In the second embodiment, there is a single sensor 45 shown in FIG. 3 that located on the side of the vibratory trough.

FIG. 4 shows the vibratory trough 10 has a substantially u-shaped cross-section and the actuation of actuator B, for example in concert with the actuation of actuator D (not shown), causes the vibratory trough to rock towards the actuators A and C. The actuation of actuators B and D is controlled by the controller 30.

Figure 5:
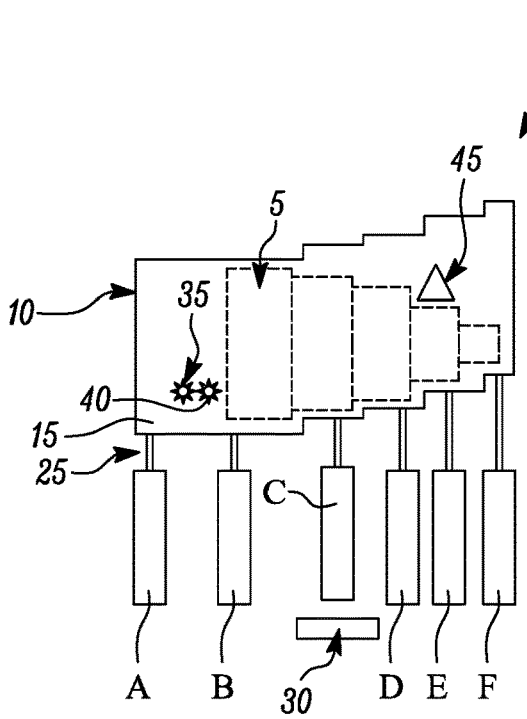
FIG. 5 is a schematic front view of a component treatment apparatus.
Figure 6:
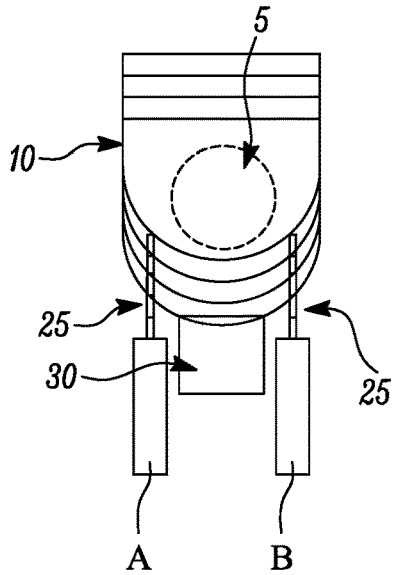
FIG. 6 is a schematic side view of the component treatment apparatus that is shown in FIG. 5.

FIGS. 5 and 6 depict a third embodiment of the component treatment apparatus of the present disclosure. They provide a schematic front view and a schematic side view of the embodiment respectively. The third embodiment shares many of the features of the first and second embodiments and the reference numerals in FIGS. 5 and 6 that also appear in FIG. 1, 2, 3 or 4 refer to corresponding the features. In the third embodiment the component 5 is a bladed disk drum of a gas turbine engine and the vibratory trough is shaped, e.g. stepped, to readily accommodate such a component. In this way a uniform gap can be maintained between the bottom of the vibratory trough and each stage of bladed disk drum. This helps to provide the optimal forces required at each stage of the bladed disc for uniform peening/polishing. The component treatment apparatus includes a system of six actuators A to F and actuator extension rods 25 for rocking or otherwise moving the vibratory trough as desired. The number and placement of actuators reflects the shape of the vibratory trough designed for the component concerned. The operation of the actuators and the actuator extension rods is controlled by the controller 30 in response to signals received from a sensor 45 located on the inner side of the vibratory trough in close proximity to the component to be treated.

FIG. 6 shows the vibratory trough 10 has a substantially u-shaped cross-section and the actuation of all actuators in concert (actuators C to F not shown) causes the vibratory trough to move upwards and downwards as required and as controlled by the controller 30.

Figure 7:
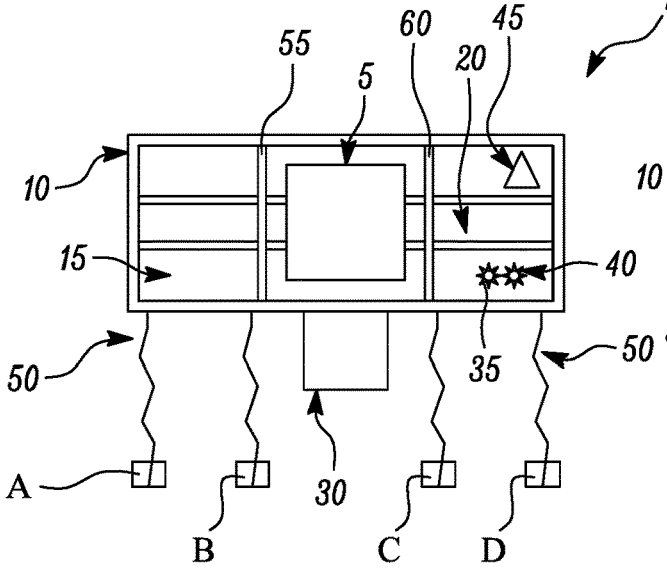
FIG. 7 is a schematic front view of a component treatment apparatus.
Figure 8:
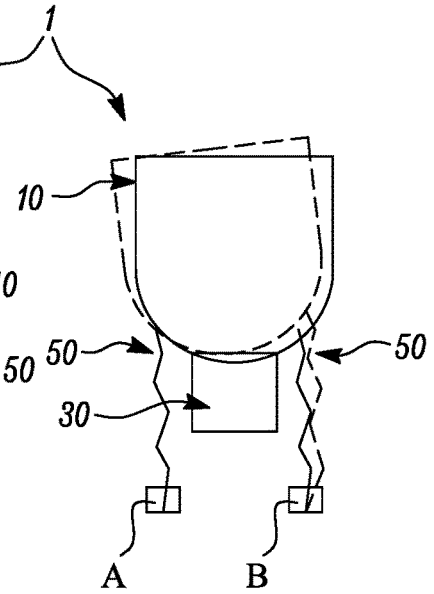
FIG. 8 is a schematic side view of the component treatment apparatus that is shown in FIG. 7.

FIGS. 7 and 8 depict a fourth embodiment of the component treatment apparatus of the present disclosure. They provide a schematic front view and a schematic side view of the embodiment respectively. The fourth embodiment shares many of the features of the first, second and third embodiments and the reference numerals in FIGS. 7 and 8 that also appear in FIG. 1, 2,3, 4, 5 or 6 refer to corresponding the features. The component support 20 is a support shaft, e.g. a hollow support shaft, that spans each end of the vibratory trough 10. The vibratory trough includes a first trough wall 55 and a second wall 60 that are located in the vibratory trough. Each of the first and second trough walls has an aperture through which the support shaft can pass. In use, the support shaft 20 is passed through the component 5, and the first trough wall 55 and the second trough wall 60 are located on the support shaft either side of the component to support the component in a desired position within the vibratory trough. In this way the support shaft is removably locatable within the vibratory trough 10 and shaped to support the component to be treated in the component treatment apparatus. In the embodiment shown the component to be treated includes a channel through which the support shaft can be passed to support the component within the vibratory trough of the component treatment apparatus. If the component includes a pair of recesses rather than a channel the component can be supported within the vibratory trough using a pair of the support shafts rather than a single support shaft. The first trough wall 55 and the second trough wall 60 can be formed, shaped, angled and/or positioned in accordance with the desired requirements.

In the fourth embodiment each actuator A to D is in the form of a shape memory alloy excitation unit and each shape memory alloy excitation is provided with a shape memory alloy spring 50. The controller 30 receives signals from a sensor 45 that is located on the inner side of one end of the vibratory trough, and receives signals from some additional sensors that are not shown in FIG. 7 or 8. The controller also controls the excitation unit to vary the spring extension and thereby move, e.g. rock, the vibratory trough as required.

Figure 9:
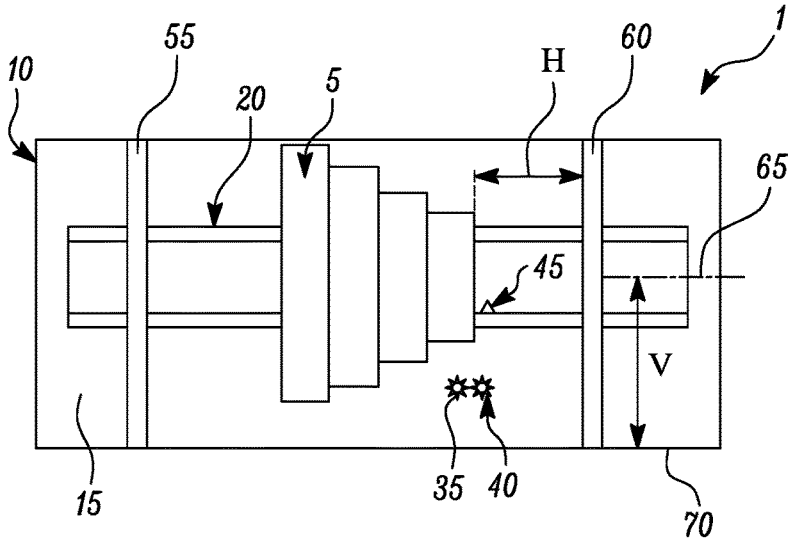
FIG. 9 is a perspective side view of a bladed disk drum of a gas turbine.
Figure 10:
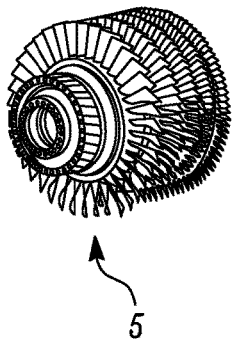
FIG. 10 is a schematic representation that shows how a component, more particularly the bladed disk drum of FIG. 9, can be mounted within a component treatment apparatus in preparation for the surface of the bladed disk drum to be treated in accordance with the method of the present disclosure.

FIG. 9 is a perspective side view of a bladed disk drum of a gas turbine engine, which is an example of a component 5, and FIG. 10 is a schematic representation that shows how the bladed disk drum of FIG. 9 can be mounted on a hollow shaft support 20 between the first trough wall 55 and the second trough wall 60 of the fourth embodiment of the component treatment apparatus 1 in preparation for the surface of the bladed disk drum to be treated in accordance with the method of the present disclosure. In FIG. 10, H is the horizontal distance between the bladed disk drum 5 and the second trough wall 60, and V is the vertical distance between a rotational axis 65 of the bladed disk drum 5 and the bottom 70 of the vibratory trough wall. V and H will depend on the geometry of the vibratory trough and the geometry of the bladed disk drum that is mounted on the hollow shaft support 20 within the vibratory trough 10. H may, for example, be from ⅕ to ⅓ times the distance between the first trough wall 55 and the second trough wall 60, and V may, for example, be from ⅕ to ½ times the width of the vibratory trough. The geometry of the vibratory trough and the geometry of the bladed disk drum determine the energy, velocity, force, and pressure that is required to achieve a desired vibratory treatment of the component concerned, in this case the bladed disk drum 5 of FIG. 9.

Figure 11:
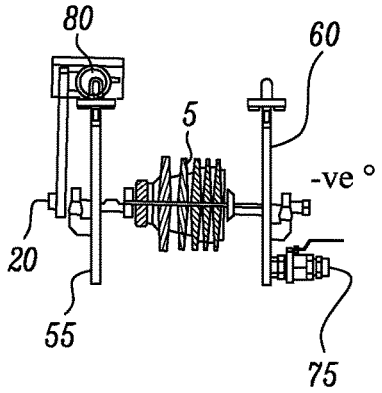
FIG. 11 is a schematic side view of a bladed disk drum of the gas turbine engine that is mounted on a compound support in the form of a hollow support shaft, the hollow support shaft being negatively inclined so that the tips of the blades of the bladed disk drum are substantially parallel to the bottom of the vibratory trough, which is substantially parallel to the ground on which the component treatment apparatus stands.

In a fifth embodiment of the component treatment apparatus of the present disclosure the component support 20 is in the form of a support shaft, e.g. a hollow support shaft, and the component support 20 is movable to enable different sections of the component mounted thereon to be uniformly treated within the vibratory trough. FIG. 11 is a schematic side view of a component 5 in the form of a bladed disk drum of a gas turbine engine that is mounted on a support shaft 20 and received through an aperture formed in the first trough wall 55 and an aperture formed in the second trough wall 60. The component treatment apparatus has a trough wall motor 75 that enables the second trough wall 60 to be moved with respect to the vibratory trough, e.g. vertically, and a component support motor 80 that enables the compound support 20 to be moved with respect to the vibratory trough, e.g. vertically. The component support motor 80 and the trough wall motor 75 can be operated in combination, e.g. manually or controlled by the controller 30, to adjust the inclination of the support shaft 20 within the vibratory trough 10 to enable different sections of the bladed disk drum to be uniformly treated within the vibratory trough. In FIG. 11 the compound support 20 is negatively inclined so the tips of the blades of the bladed disk drum 5 are substantially parallel to the bottom of the vibratory trough, which is substantially parallel to the ground on which the component treatment apparatus stands.

Figure 12:
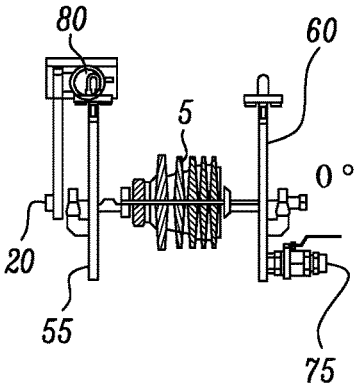
FIG. 12 is a schematic side view of the bladed disk drum of the gas turbine engine that is mounted on the hollow support shaft of the component treatment apparatus shown in FIG. 11, however the shaft is not inclined so the tips of the blades of the bladed disk drum are not quite parallel to the bottom of the vibratory trough.

In FIG. 12 the compound support 20 is not inclined so the tips of the blades of the bladed disk drum 5 are not quite parallel to the bottom of the vibratory trough so different sections of the bladed disk drum will not be uniformly treated. The extent and significance of that non-uniformity of treatment will depend on the geometry of the vibratory trough and the geometry of the bladed disk drum.

Figure 13:
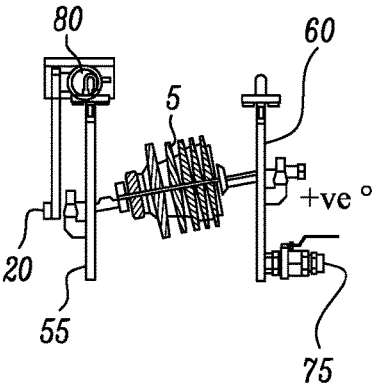
FIG. 13 is a schematic side view of a bladed disk drum of gas turbine engine that is mounted on the hollow support shaft of the component treatment apparatus shown in FIGS. 11 and 12, the shaft being positively inclined to an extent such that the drum section of the bladed disk drum is substantially parallel to the bottom of the vibratory trough.

In FIG. 13 the compound support 20 is positively inclined to an extent such that the drum section of the bladed disk drum 5 is substantially parallel to the bottom of the vibratory trough, which is substantially parallel to the ground on which the component treatment apparatus stands.

Figure 14:
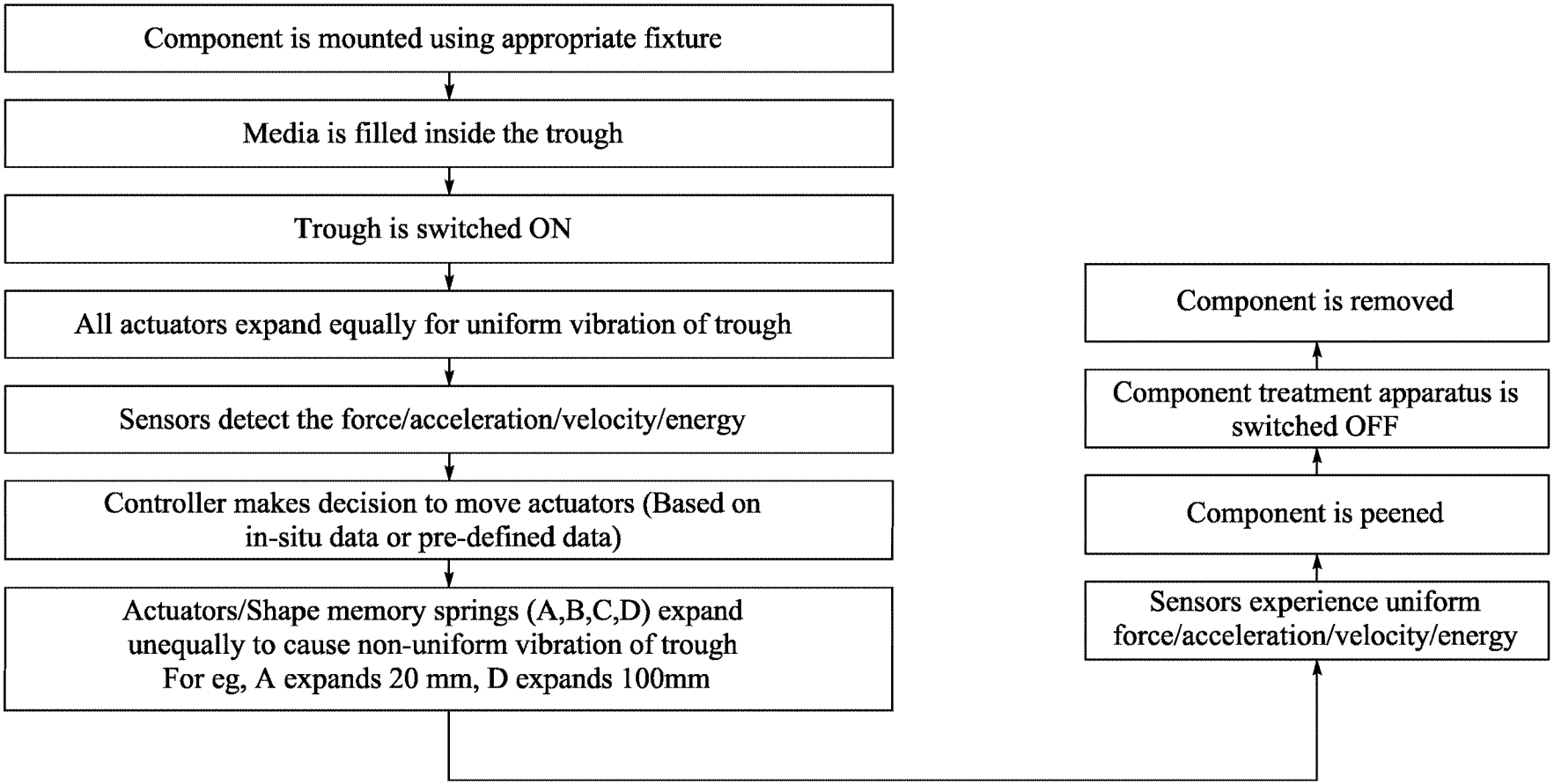
FIG. 14 is a flow chart that depicts a method by which the surface of a component is treated using a component treatment apparatus, e.g. the component treatment apparatus shown in any of FIGS. 1 to 13.

Having described the component treatment apparatus 1 of the present disclosure in the form of five embodiments FIG. 14 is a flow chart that depicts the method by which the surface of a component is treated using such a component treatment apparatus to modify the mechanical and surface properties of the component.

The vibratory trough 10 can be designed and the first trough wall 55 and the second trough wall 60 can be formed, shaped, angled and/or positioned in accordance with the desired requirements to ensure that the component 5 treated in the component treatment apparatus 1 is modified in a way that the component with desired mechanical and surface properties.

Figure 15:
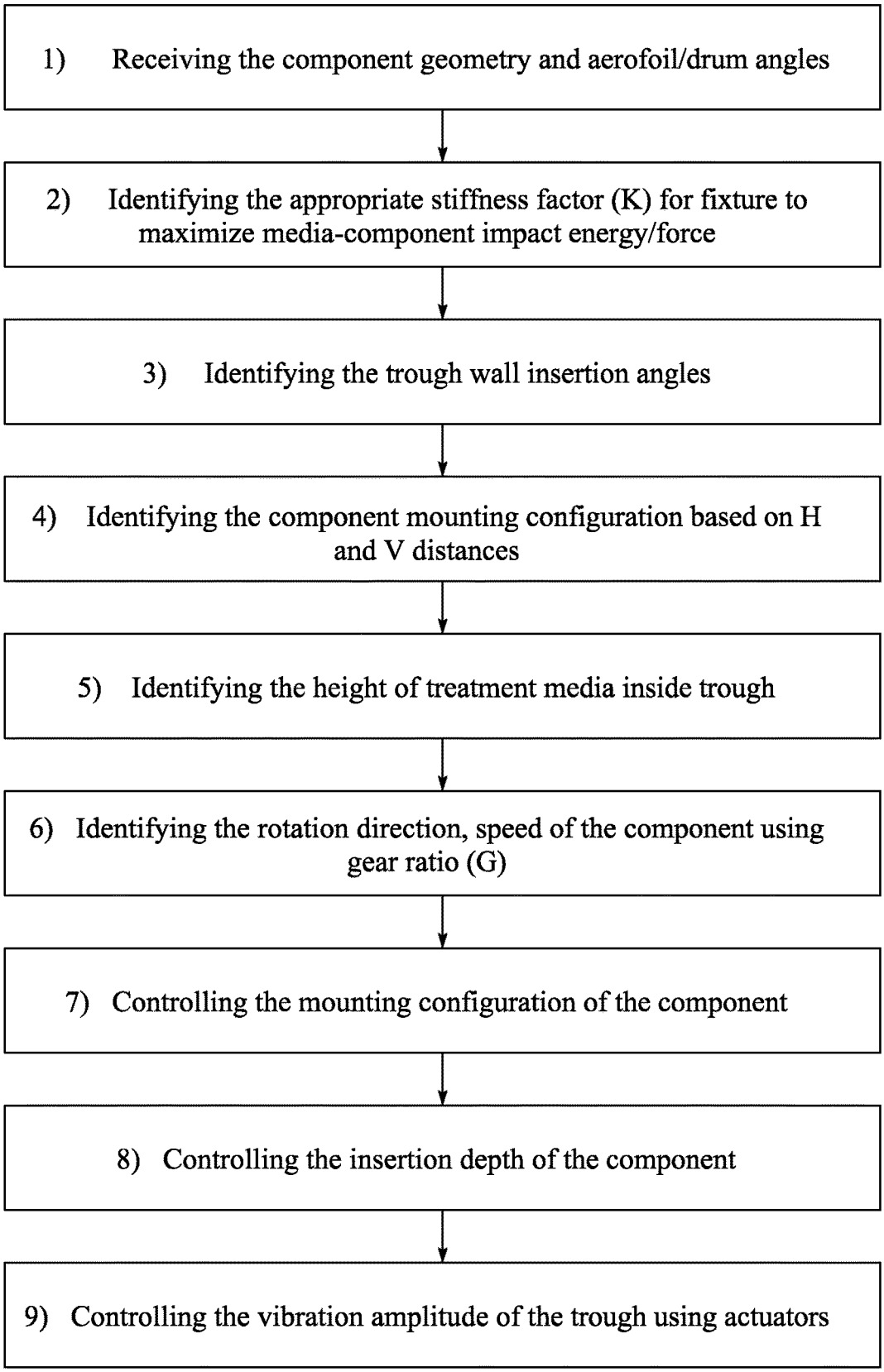
FIG. 15 is a flow chart that depicts a method by which the surface of a component is treated using a component treatment apparatus, e.g. the component treatment apparatus shown in any of FIGS. 1 to 8.

FIG. 15 is a flow chart that depicts the method by which the surface of a component in the form of a bladed disk drum is treated using a component treatment apparatus of the present disclosure so that desirable mechanical and surface properties are obtained. It does this with reference to suitably mounting the bladed disk drum onto the component support and controlling the positioning of the first and second trough walls within the vibratory trough.

It will be understood that the disclosure is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method for modifying the mechanical and surface properties of a component, the method comprising the steps of:

(a) removably attaching a component to at least one component support that is located within a vibratory trough of a component treatment apparatus, the at least one component support being a support shaft upon which the component is removably mountable within the vibratory trough;

(b) supplying the vibratory trough with treatment media;

(c) moving the component support or the vibratory trough so that the component is immersed into the treatment media;

(d) vibrating the vibratory trough to provide a substantially uniform surface treatment of the component, the vibratory trough being movable by at least one trough vibrating mechanism whose actuation is controlled by a controller in response to signals received from at least one sensor located on or within the vibratory trough;

(e) removing the component from the treatment media; and (f) detaching the component from the component support, wherein the vibrating of the vibratory trough includes controlling the energy of peening by adjusting height, volume, and mass of the treatment media through movement of at least one trough wall in the vibratory trough.

2. The method of claim 1, wherein the treatment media supplied to the vibratory trough is selected from a metal, a composite material and a plastic material.

3. The method of claim 2, wherein the treatment media is a metal selected from stainless steel, carbon steel and copper.

4. The method of claim 1, wherein the treatment media is formed as cones, ball cones, spheres, pyramids or angle cut cylinders.

5. The method of claim 1, wherein the inclination of the component support is adjustable within the vibratory trough to enable selected portions of the component to be uniformly treated within the vibratory trough.

6. The method of claim 1, wherein the component is a gas turbine engine component.

7. The method of claim 6, wherein the gas turbine engine component is a bladed disk drum or a fan blade.

8. A component treatment apparatus for modifying the mechanical and surface properties of a component, the component treatment apparatus comprises:

a vibratory trough for receiving and retaining treatment media;

a component support that supports the component within the vibratory trough, the component support being a support shaft upon which the component is removably mountable within the vibratory trough;

at least one sensor that is mounted on the vibratory trough;

at least one trough vibrating mechanism that causes the vibratory trough to vibrate; and a controller that controls the at least one trough vibrating mechanism in response to signals received by the at least one sensor thereby controlling the vibratory motion of the vibratory trough, wherein the vibratory trough includes at least one trough wall configured to control the energy of peening by adjusting height, volume, and mass of the treatment media through movement of the at least one trough wall.

9. The component treatment apparatus of claim 8, wherein the vibratory trough has a substantially u-shaped cross-section or has a shape that corresponds at least in part to the shape of the component.

10. The component treatment apparatus of claim 8, wherein the vibratory trough has at least one guide vane that directs a flow of treatment media over the component to optimize local energy flow on the component.

11. The component treatment apparatus of claim 8, wherein the at least one trough vibrating mechanism comprises an actuator and an actuator extension rod or a shape memory alloy spring.

12. The component treatment apparatus of claim 8, wherein the at least one sensor is a plurality of sensors located on and around the vibratory trough and/or one sensor is located adjacent the component within the vibratory trough.

13. The component treatment apparatus of claim 8, wherein the vibratory trough has a treatment media inlet for controllably supplying the treatment media into the vibratory trough and a treatment media outlet for controllably emptying the treatment media from the vibratory trough, control of the treatment media inlet and the treatment media outlet being provided by the controller or an additional controller.

14. The component treatment apparatus of claim 8, wherein the component is a gas turbine engine component.

15. The component treatment apparatus of claim 14, wherein the component is a bladed disk drum or a fan blade.

16. The component treatment apparatus of claim 8, wherein the at least one sensor is programmed to measure the acceleration of the component due to vibration and the impact force exerted by the media on the component.

17. The component treatment apparatus of claim 8, wherein the controller is further configured to (i) control the at least one trough vibrating mechanism such that all actuators expand equally for uniform vibration of the vibratory trough, and (ii) in response to the signals received by the at least one sensor, controlling the actuators to expand unequally.

* * * * *